US009844954B2

(12) United States Patent
Balasini et al.

(10) Patent No.: US 9,844,954 B2
(45) Date of Patent: Dec. 19, 2017

(54) DOCUMENT FEEDERS FOR PRINTERS AND PRINTERS COMPRISING THE DOCUMENT FEEDERS

(71) Applicant: SHENZHEN PU YING INNOVATION TECHNOLOGY CORPORATION LIMITED, Shenzhen (CN)

(72) Inventors: Flavio Balasini, Ivrea (IT); Paolo Poma, Ivrea (IT)

(73) Assignee: SHENZHEN FU YING INNOVATION TECHNOLOGY CORPORATION LIMITED, Shenzhen (CN)

( * ) Notice: Subject to any disclaimer, the term of this patent is extended or adjusted under 35 U.S.C. 154(b) by 0 days.

(21) Appl. No.: 15/124,966

(22) PCT Filed: Mar. 19, 2014

(86) PCT No.: PCT/EP2014/055486

§ 371 (c)(1),
(2) Date: Sep. 9, 2016

(87) PCT Pub. No.: WO2015/139742

PCT Pub. Date: Sep. 24, 2015

(65) Prior Publication Data

US 2017/0015116 A1 Jan. 19, 2017

(51) Int. Cl.
*B41J 11/00* (2006.01)
*G03G 15/00* (2006.01)
(Continued)

(52) U.S. Cl.
CPC ..... *B41J 11/0035* (2013.01); *B41J 11/003* (2013.01); *B41J 11/22* (2013.01);
(Continued)

(58) Field of Classification Search
CPC .. B41J 11/0095; B41J 11/009; B41J 2/14153; B41J 11/008; B41J 11/42; B41J 2/04505;
(Continued)

(56) References Cited

U.S. PATENT DOCUMENTS 8,570,589 B2 * 10/2013 Togami ..... G03G 15/5029 347/15
2005/0275156 A1 12/2005 Flynn et al.
2012/0008998 A1 1/2012 Kannari et al.

FOREIGN PATENT DOCUMENTS

EP 0234556 A1 9/1987
EP 1591387 A1 11/2005
WO 2012/017624 A1 2/2012

OTHER PUBLICATIONS

International Search Report dated Dec. 5, 2014 from International Application No. PCT/EP2014/055486, pp. 1-5.

* cited by examiner

*Primary Examiner* — Lamson Nguyen
(74) *Attorney, Agent, or Firm* — MH2 Technology Law Group LLP

(57) ABSTRACT

A document feeder for a printer may include an upper part and/or a lower part. The upper part may include a feeding roller arrangement configured to engage with an upper face of a document. The lower part may include a retaining surface. The lower part may further include a sliding element which, in at least an operation mode of the document feeder, may have a portion that projects with respect to the retaining surface for supporting a lower face of the document in such a way that at least a portion of the document is raised with respect to the retaining surface.

19 Claims, 13 Drawing Sheets

(51) Int. Cl.

| | |
|---|---|
| ***B65H 1/04*** | (2006.01) |
| ***B65H 3/06*** | (2006.01) |
| ***B65H 3/66*** | (2006.01) |
| ***B65H 7/02*** | (2006.01) |
| ***B41J 11/22*** | (2006.01) |
| ***B65H 5/06*** | (2006.01) |
| ***B65H 5/36*** | (2006.01) |

(52) U.S. Cl.
CPC ..... *B65H 1/04* (2013.01); *B65H 3/0638* (2013.01); *B65H 3/0684* (2013.01); *B65H 3/66* (2013.01); *B65H 5/06* (2013.01); *B65H 5/36* (2013.01); *B65H 7/02* (2013.01); *G03G 15/6511* (2013.01); *B65H 2401/111* (2013.01); *B65H 2402/46* (2013.01); *B65H 2404/1119* (2013.01); *B65H 2404/14211* (2013.01); *B65H 2407/21* (2013.01); *B65H 2511/10* (2013.01); *B65H 2511/212* (2013.01); *B65H 2511/414* (2013.01); *B65H 2511/416* (2013.01)

(58) Field of Classification Search
CPC ..... B41J 2/04541; B41J 2/0458; B41J 3/28; B41J 11/06; B41J 2/04508; B41J 2/04558; B41J 2/07; B41J 11/003; B41J 11/0035; B41J 11/22; B65H 3/0638
See application file for complete search history.

DOCUMENT FEEDERS FOR PRINTERS AND PRINTERS COMPRISING THE DOCUMENT FEEDERS

CROSS-REFERENCE TO RELATED APPLICATION(S)

This application is a national stage entry from international Application No. PCT/EP2014/055486, filed on Mar. 19, 2014, in the Receiving Office ("RO/EP") of the European Patent Office ("EPO"), and published as International Publication No. WO 2015/139742 A1 on Sep. 24, 2015, the entire contents of are incorporated herein by reference.

The present invention relates to a printer or the like. More in particular, the present invention relates to an improved document feeder for a printer.

In the present description and claims the term "printer" should be intended as including any peripheral device to be connected (by any means, such as through a cable, a wireless link, an infrared link or the like) to a computer, a personal computer, a smart phone or the like and configured for managing sheets. Examples of "printer" are: a printer for printing one single sheet of paper or a plurality of sheets of paper possibly connected together; a printer for printing one or more sheets of a material other than paper; a scanner, a facsimile machine or a peripheral incorporating two or more of the above functionalities.

In the art, several different designs of printers are known. The difference being at least in the printing technology (laser printing, ink-jet printing, dot-matrix printing, . . . ) and/or in the main intended use (domestic use, small office use, large companies use, . . . ). Printers which are designed for private use or use by a rather reduced number of people as in a small office are generally rather compact in size because they are intended to be supported on a desk or table in proximity of the computer of the user.

The present description will refer more specifically to printers designed for use in a bank, post office, public office or the like. The above specific reference to bank (including post office or the like) environment is not intended to limit the scope of protection in no way and the present invention is equally applicable to printers to be used in any other private or business environment.

Several different documents are fed by a bank clerk into a printer. The documents are different one from the others at least because of their nature, shape and size. Some documents are fed singularly, some others are fed in stacks or the like.

In the art, automatic document feeder devices (briefly, ADF) are known. An ADF is used when a plurality of documents, arranged in stacks, is fed in a printer: the document which is at the top of the stack is taken by the ADF and conducted to the printing stage(s) within the printer.

Each of the documents to be fed can comprise a single sheet or a plurality of sheets (multi-copy documents). Those which comprise a plurality of sheets typically comprise a single glued edge where sheets are glued together. The other edges are not glued. Typically, the glued edge is the leading edge, namely the edge which is first fed. In other documents, the glued edge is a lateral edge.

SUMMARY OF THE INVENTION

The Applicant has noticed that feeding a small size document or a multi-copy document having a glued lateral edge into a feeding opening of a printer can be disadvantageous. In particular, in certain printers wherein the rim of the feeding opening is at a certain distance from the aligning devices starting the paper path, it is not possible to position the small size document or the multi-copy document by hand. In fact, the operator, due to the dimensions and shape of the printer body, can not see and properly identify the aligning devices and/or the infrared detectors and he can not arrange the document appropriately.

The Applicant has also noted that a known ADF can not be used to feed a multi-copy document having a glued lateral edge up to the alignment device. This because the known ADF would identify a multi-copy document having a glued lateral edge as a plurality of single sheets. Therefore, a known ADF would tend to separate the top sheet from the other(s) sheet(s).

In view of the above, the Applicant has tackled the problem of feeding a small size document or a multi-copy document having a glued lateral edge at least from a feeding opening of a printer to an alignment device and/or to a presence detector.

The Applicant has observed that the above problem can be solved by a document feeder for a printer or the like with a lower part provided with a sliding element which, in at least an operation mode of the document feeder, has a portion projecting with respect to a retaining surface for supporting a lower face of the document in such a way that at least a portion of said document is maintained raised with respect to the retaining surface.

According to a first aspect, the present invention relates to a document feeder for a printer or the like, wherein the document feeder comprises a upper part and a lower part, wherein said upper part comprises a feeding roller arrangement for engaging with an upper face of a document and wherein said lower part comprises a retaining surface, wherein said lower part also comprises a sliding element which, in at least an operation mode of the document feeder, has a portion projecting with respect to said retaining surface for supporting a lower face of the document in such a way that at least a portion of said document is raised with respect to said retaining surface.

The sliding element may comprise a sliding teeth which is rotatable around a rotation axis.

The lower part may comprise a spring for spring loading the sliding element in the projecting position.

The spring may be preloaded with a load between 10 g and 30 g.

The sliding element may be comprised with a thermoplastic material. For instance, it can comprise a blend of polyphenylene oxide and polystyrene.

At least the projecting portion of said sliding element has a friction coefficient between about 1.0 and 1.1.

The lower part can be movable in such a way that it can become recessed below a floor of a feeding opening of the printer.

The lower part may be rotatable.

The feeding roller arrangement may comprise two motorized feeding rollers.

The outer surface of the feeding rollers may be profitably covered or lined with a layer providing a rather high friction with a document. Such layer could be a rubber or the like.

The feeding roller arrangement may comprise a trough between the two feeding rollers.

According to a second aspect, the present invention relates to a printer comprising a feeding opening comprising a floor, further comprising a document feeder as set forth above.

The printer may also comprise sensor means for detecting a document presence.

In one embodiment, one document output is selected among a plurality of outputs according to the detected size of the document. In turn, the size of the document may be detected based on said sensor means.

BRIEF DESCRIPTION OF THE DRAWINGS

Embodiments of the present invention will be better understood by reading the following detailed description, to be read by referring to the accompanying drawings, wherein.

DETAILED DESCRIPTION OF PREFERRED EMBODIMENTS OF THE INVENTION

Figure 1:
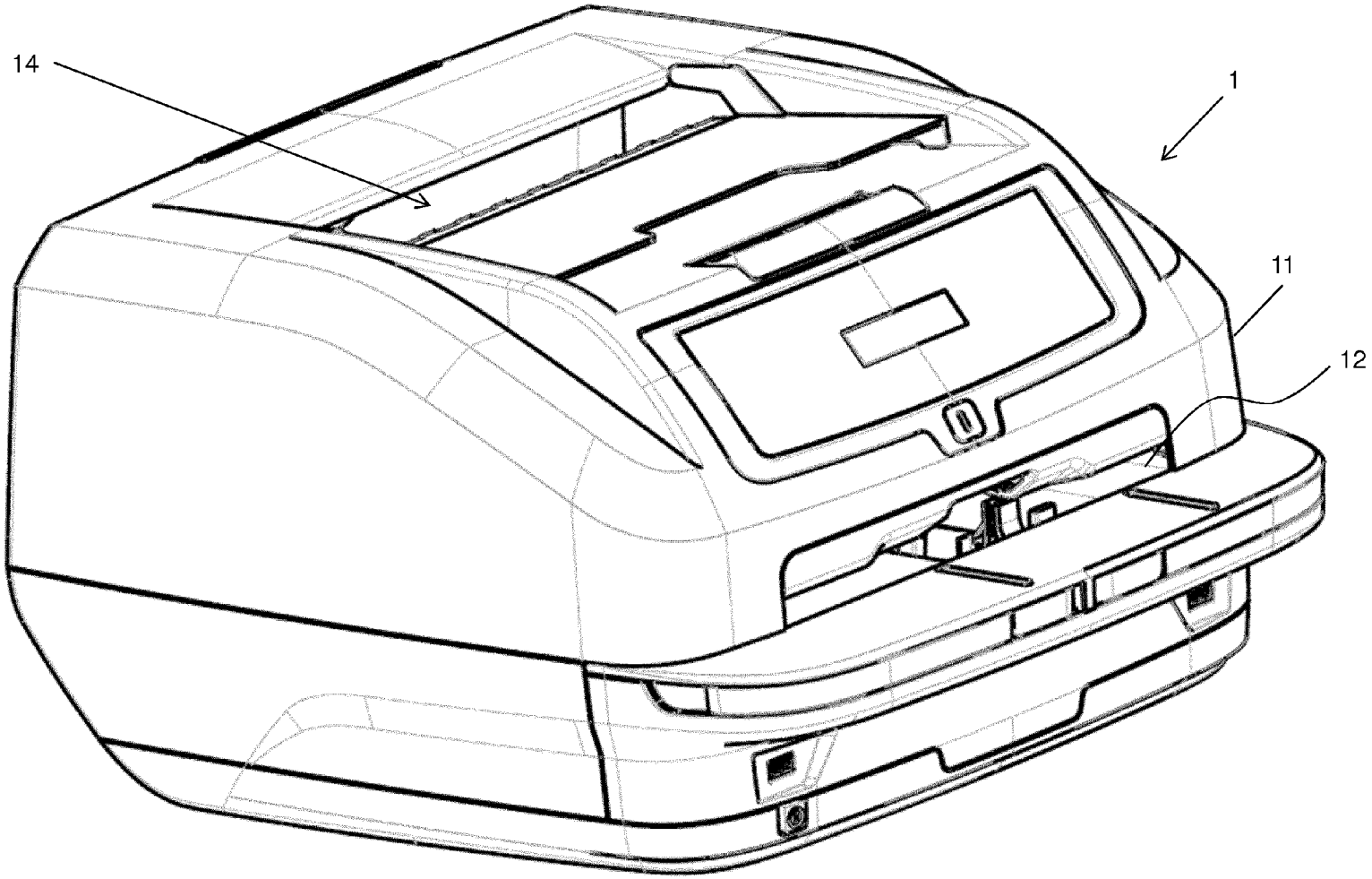
FIG. 1 is a axonometric view of a printer according to an embodiment of the present invention.

FIG. 1 schematically shows a printer 1 according to an embodiment of the present invention. The printer 1 comprises a main body 11. The printer comprises a feeding opening 12 for feeding one or more documents D to the printer and an upper output paper tray 14. Additional output paper trays or output paper trays arranged in different positions could be provided without changing the scope of protection of the present invention. A document D, after being printed, could be also returned to the feeding opening.

Figure 8:
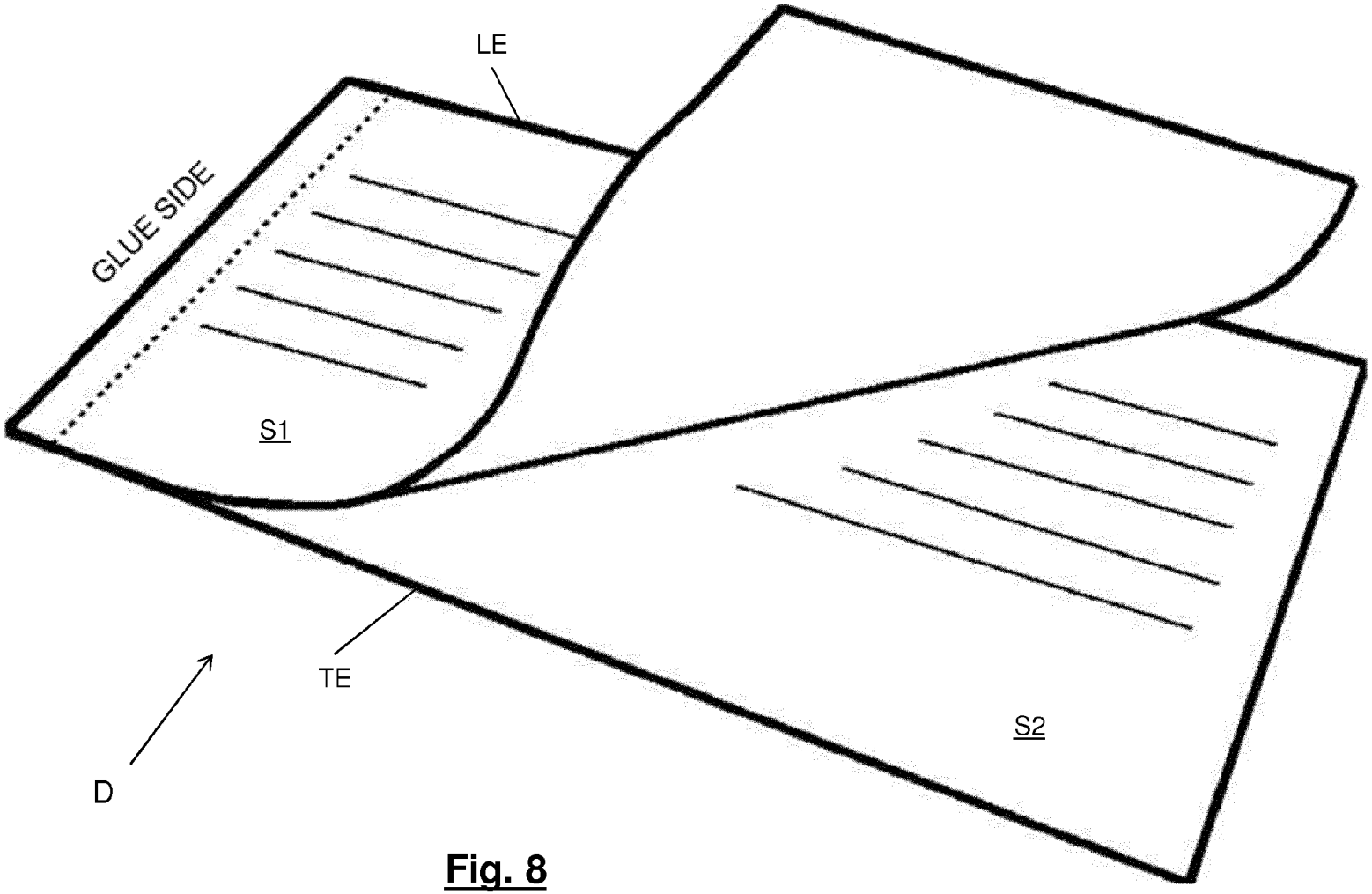
FIG. 8 is a view of an exemplary document which is glued along a lateral side.

For the present description and claims, the term "document" will indicate a layer of material to be threated. Such a layer of material may comprise one or more sheets. The sheets may be connected (typically glued) together along a front edge or a lateral edge. The sheet(s) may be at least partially pre-printed or may be "white" sheets (without any characters and digits thereon). The sheet(s) can be essentially made of, or can comprise, paper or the like. FIG. 8 shows an exemplary document D formed by two sheets S1, S2 which are glued along only a lateral side (left side in FIG. 8). At the opposite lateral side, the sheets S1, S2 are not connected together as it is shown in FIG. 8. The two sheets are also not connected along leading edge LE and trailing edge TE.

Figure 2A:
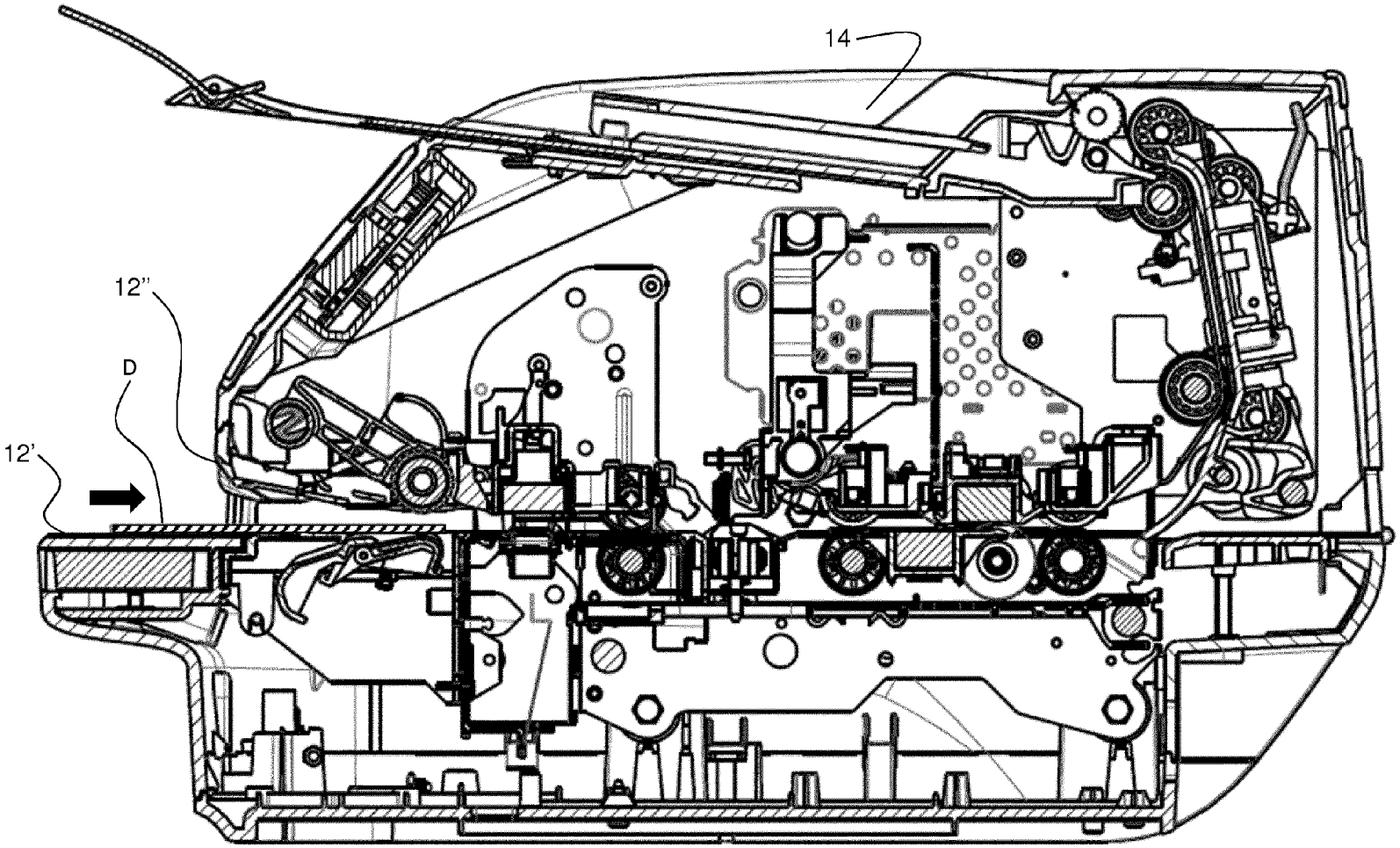
FIG. 2*a* is a simplified cross section of the printer of FIG. 1, with a document which is at about the beginning of the paper path.
Figure 2B:
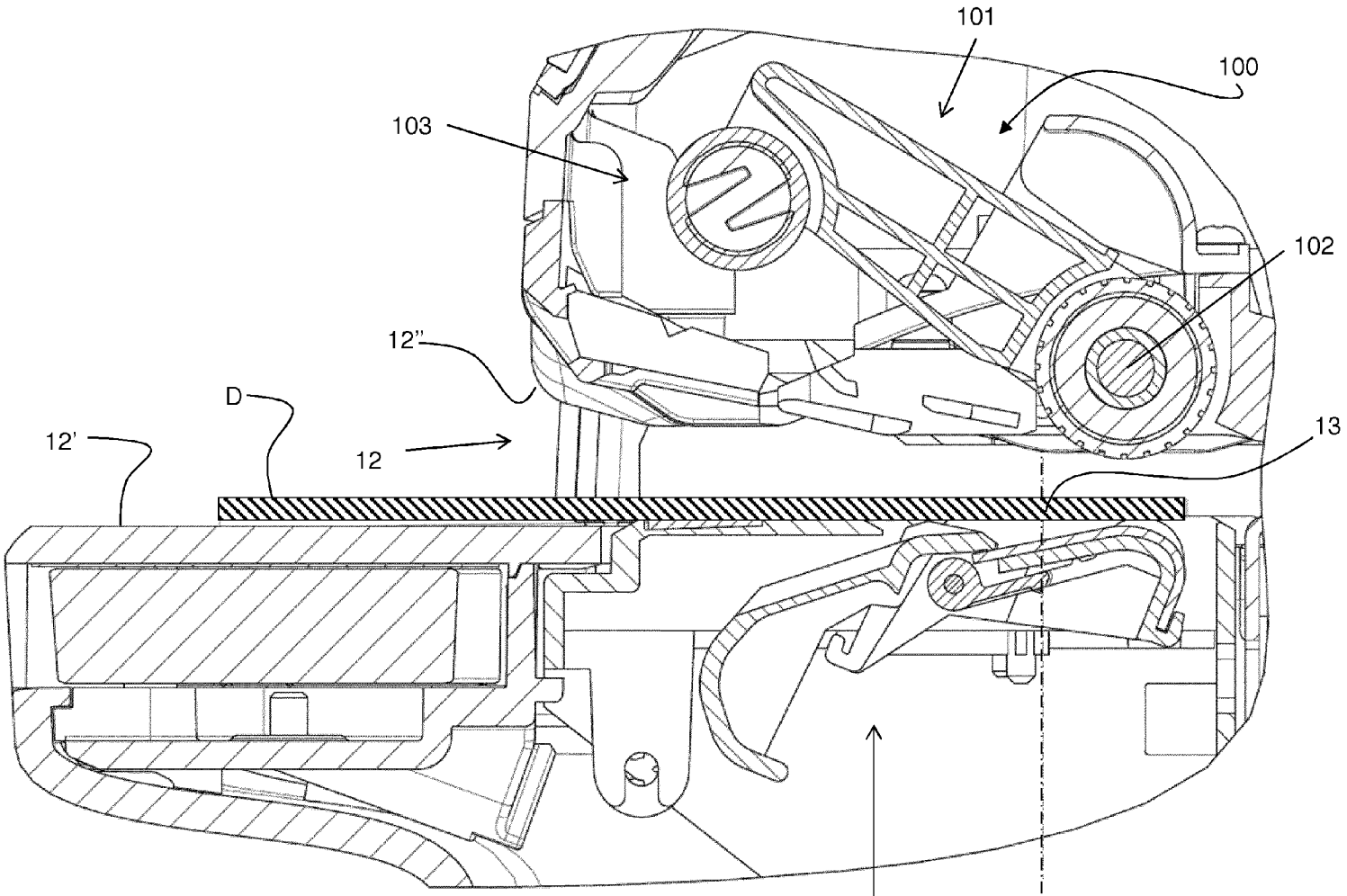
FIG. 2*b* is an enlarged view of a portion of FIG. 2*a;*

FIGS. 2*a* and 2*b* are cross sections of a printer provided with an improved document feeder ADF according to an embodiment of the present invention. While the various parts will become more clear with reference to other Figures (showing enlarged parts), it should be first remarked that the printer comprises a feeding opening 12 with a corresponding feeding opening edge 12" and a feeding opening floor 12' on which a document D is laid.

The document D is shown with enlarged thickness for improving clarity. Also shown in FIG. 2*b* is an axis 13' of document position detectors 13 which are configured for detecting that a document D is present when it is between an infrared emitter and a corresponding receiver. Downwardly, there are provided alignment devices, printing arrangements and transportation means.

In one embodiment of printer, the document output is selected among a plurality of documents outputs according to the detected size of the document. In turn, the size of the document may be detected based on sensor means (typically said infrared document detectors 13).

Figure 3A:
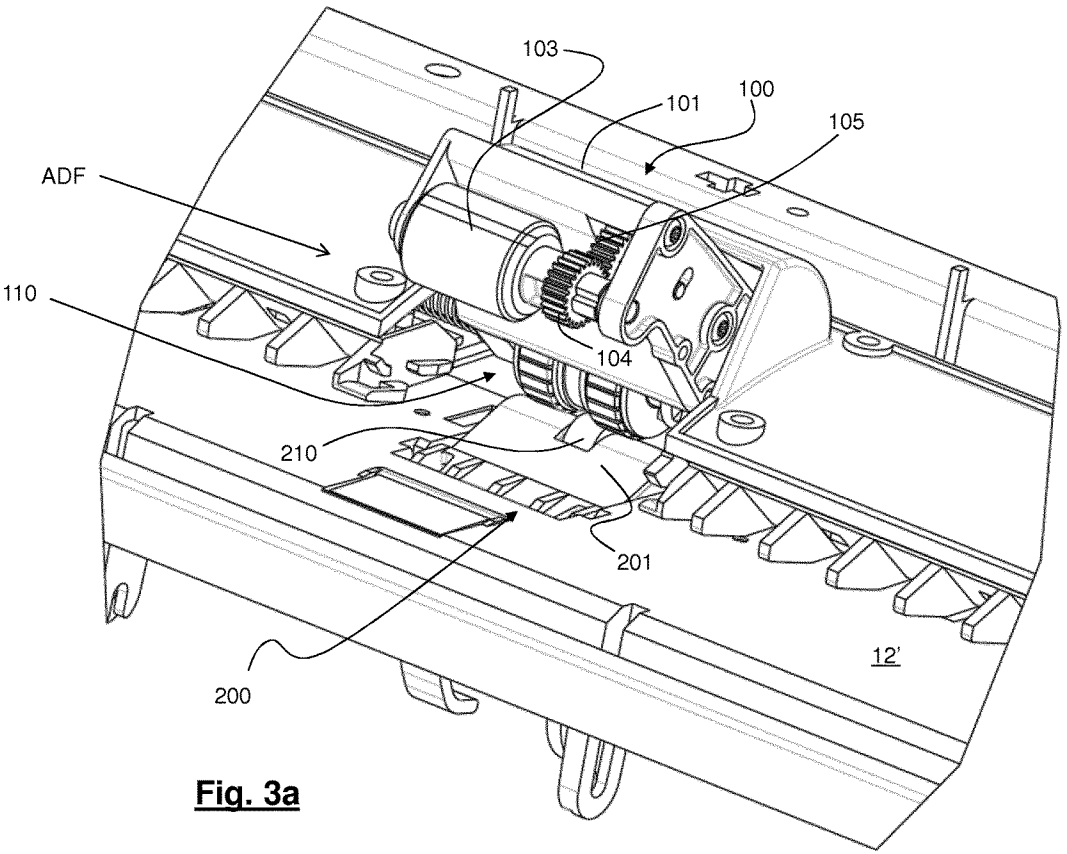
FIG. 3*a* is a partial view of the printer, without the printer body, showing the improved document feeder according to an embodiment of the present invention in a first operation mode.

FIG. 3*a*, is a partial enlarged view showing the feeding opening 12 of printer 1 with the printer body removed for a better view and understanding of the improved document feeder ADF according to an embodiment of the present invention.

The document feeder ADF of the present invention can operate substantially according to three operation modes or also according to less than three operation modes. The first operation mode is adapted to feed a single document, possibly made of two or more sheets connected along an edge, which could be a lateral edge (FIG. 8). The second operation mode is adapted to feed a plurality of documents, arranged in a stack. The third operation mode is a manual mode for feeding documents manually. The three operation modes will be disclosed below.

The improved document feeder ADF comprises an upper part 100 and a lower part 200 which will be described separately in the following description.

Figure 3B:
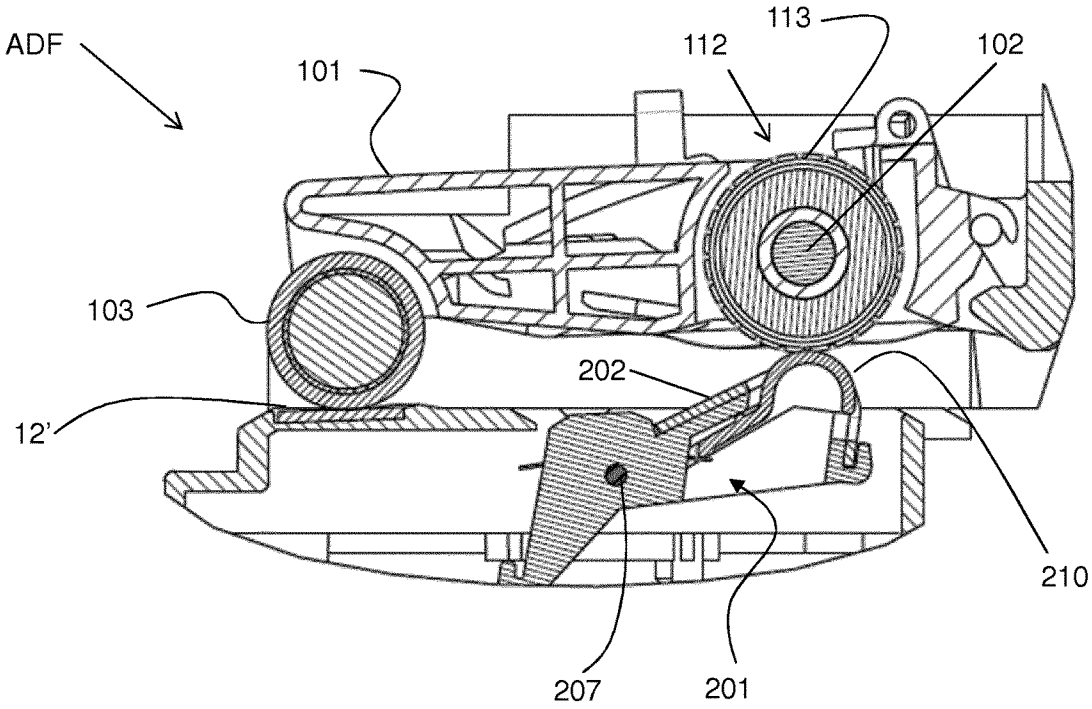
FIGS. 3*b* and 3*c* are simplified cross sections of the improved document feeder according to an embodiment of the present invention in the first operation mode.

The upper part 100 comprises a support plate 101 which is hinged around an axis 102 so that it can be rotated upwardly as shown at least in FIGS. 2*b*, 3*a* and 3*b*. The support plate 102 in turn supports a pressing roller 103 and a first gear wheel 104 which is coaxial with the pressing roller 103. An electric motor (not shown) transmits rotation movement to pressing roller 103 through the first gear wheel 104 and further gears 105, belts and/or chains.

When the pressing roller is rotated downwardly (second operation mode) and it is caused to rotate, it transports the document which is in contact with towards the printing stages.

In the first and third operation modes, the support plate is rotated upwardly and the pressing roller is in a non working configuration. In such a configuration, the pressing roller is either not caused to rotate or it is rotating but is anyway not engaging any documents. This because it is raised with respect to the floor 12' of the feeding opening 12.

Figure 6:
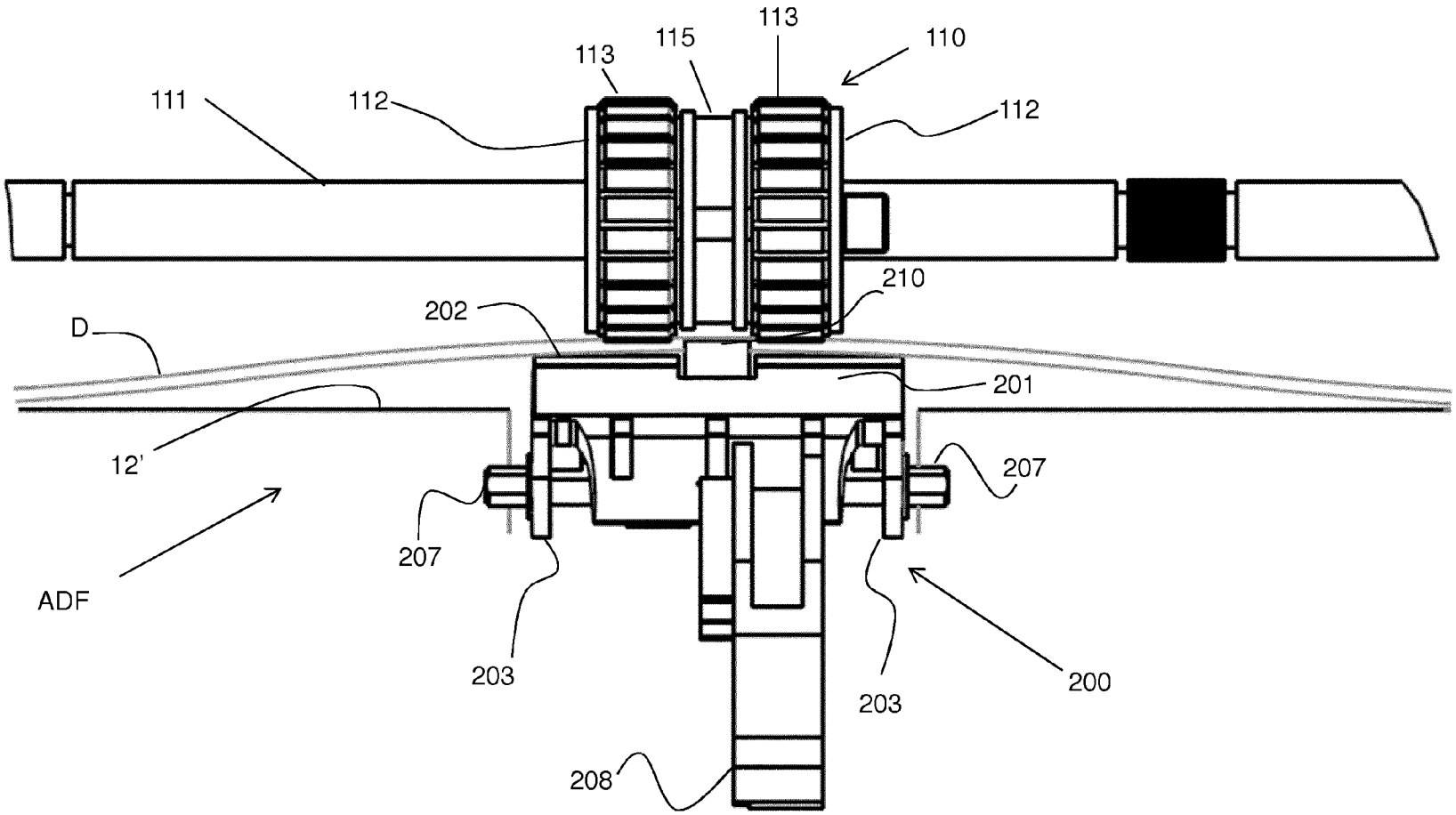
FIG. 6 is a simplified front cross section of the improved document feeder according to an embodiment of the present invention in the first operation mode with a document.

Preferably, the above mentioned motor is also connected to a feeding roller arrangement 110. A feeding roller arrangement 110 according to an embodiment of the present invention is also shown in FIG. 6. Feeding roller arrangement 110 may comprise a shaft 111 with two feeding rollers 112 mounted thereon. The feeding rollers 112 can be axially separated by a central throat or trough 115.

In embodiments of the invention, the outer surface of feeding rollers 112 is covered or lined with a material 113 providing a rather high friction with a document. Such covering material 113 could comprise a rubber material. Such rubber material could be, profitably, similar to a track with a recursive pattern of blocks. Friction coefficient of the covering material could be about 1.0-1.1 in compliance with ASTM 0618 Standard Test Mode.

The outer surface of feeding rollers 112 can be covered by a rubber such as EPDM 70±5 Shore A.

The outer surface 113 of the feeding rollers 112 is at a distance from the floor 12' of the feeding opening 12.

In embodiments of the invention, the throat 115 which is arranged axially between the feeding rollers 112 has an outer diameter lower than the diameter of the feeding rollers 112, possibly covered or lined as said above.

The outer diameter of the feeding rollers 113 (including the friction lining) can be from about 16 mm to about 20 mm. In one embodiment, the feeding roller diameter is about 19 mm±0.2 mm.

The outer diameter of the trough 115 can be from about 14 mm to about 18 mm. In one embodiment, the trough diameter is about 16 mm±0.1 mm.

Profitably, the shaft 111 can be made in two sections.

The feeding rollers 112 can be made of a plastic material such as a thermoplastic material. In one embodiment the feeding rollers can be made of a blend of polyphenylene oxide (PPO) and polystyrene (PS). A preferred material is Noryl® SE 1, GFN2, FN 215 or any other polyphenylene ether. Alternative materials could be: ABS (Acrylonitrile butadiene styrene) polymer, PET, LDPE, MDPE or HDPE or a resin material or a combination thereof.

Figure 7B:
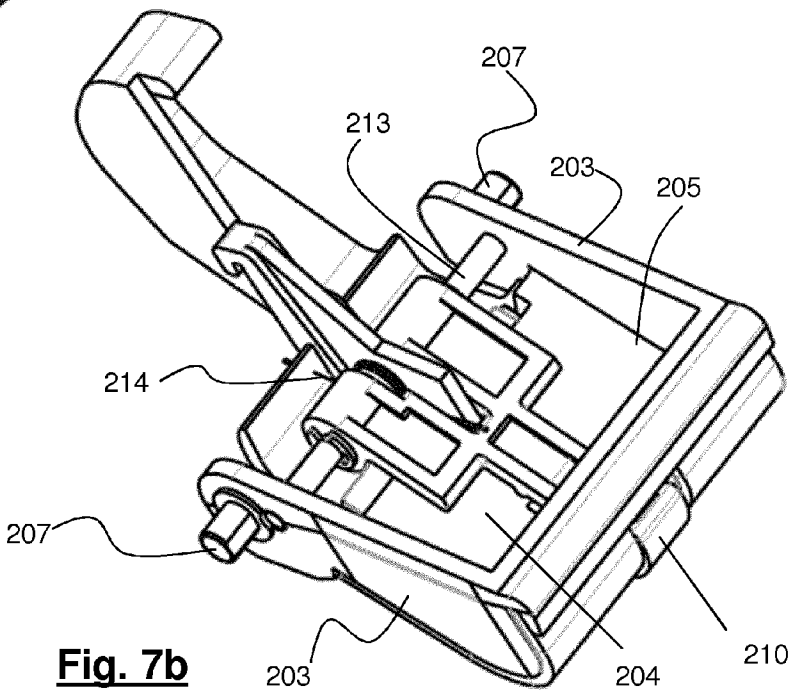
FIGS. 7*a*, 7*b* and 7*c* are simplified axonometric views of the lower component of the improved document feeder according to an embodiment of the present invention.
Figure 7A:
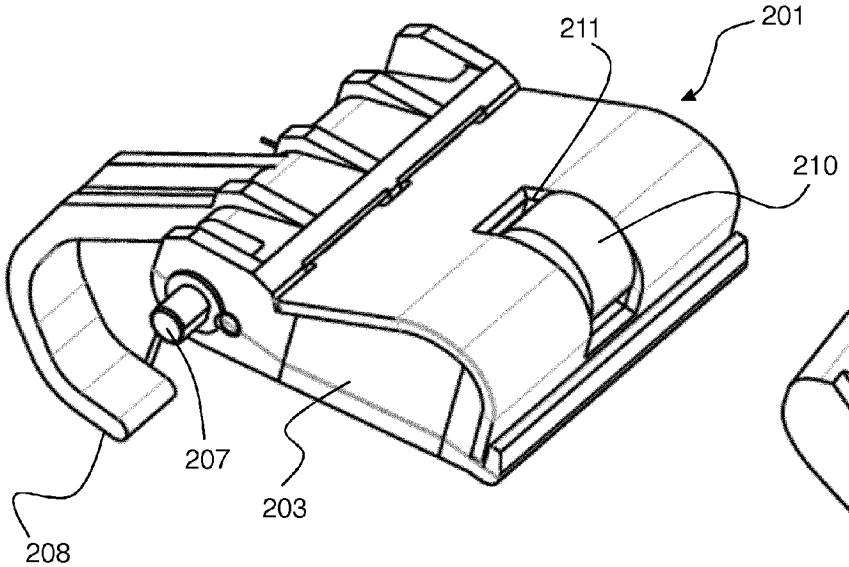
Figure 7C:
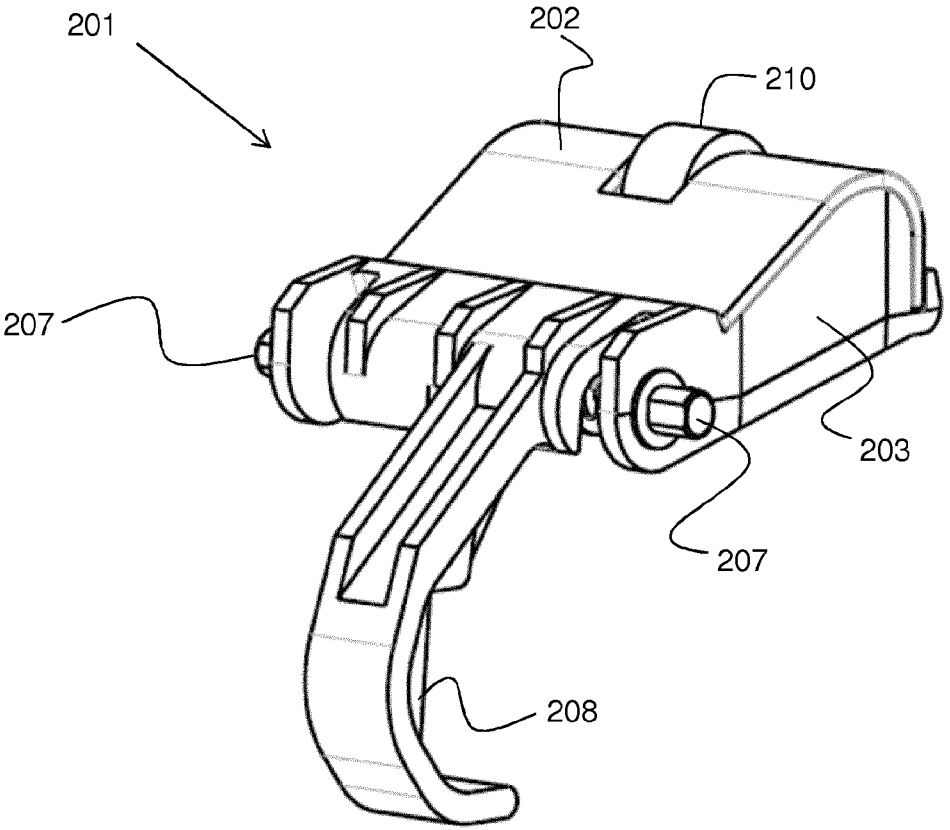

As said above, the improved document feeder ADF comprises also a lower part 200 cooperating with the upper part 100 for properly feeding certain documents D (as the document D of FIG. 8). The lower part 200 comprises a slide shoe 201 which, in operation, can (at least partially) project upwardly from a floor 12' of the feeding opening 12. The slide shoe 201 is also shown in FIGS. 7*a*, 7*b* and 7*c*. It can have a substantially concave shape with an upper retaining surface 202, two lateral sides 203 and an open lower surface 204. The upper surface 202 and the two lateral sides 203 delimit a volume 205 which is open at the bottom 204.

In use, the upper retaining surface 202 of the slide shoe 201 faces the feeding rollers 112 of the upper part 100 of the improved document feeder ADF of the present invention.

Two pins 207 project outwardly, in opposite directions, from the lateral sides 203 of the slide shoe 201. The pins 207 lay on a common axis.

A C shaped arm 208 is connected to the slide shoe 201 and projects downwardly.

The lower part 200 of the improved document feeder ADF comprises also a sliding element 210, such as sliding teeth 210. The sliding teeth 210 is arranged so that in at least one operation condition, it projects partially from the upper retaining surface 202 of the slide shoe 201 through a window 211. Preferably, the sliding teeth 210 and its window 211 are arranged centrally with respect to the lateral sides 203 of the slide shoe 201.

As shown in FIG. 7*b*, the sliding teeth 210 is mounted rotatable around an axis 213 extending in the open volume 205 of the slide shoe 201 from one lateral side 203 to the opposed one. The rotation axis 213 of the teeth 210 can be parallel to the rotation axis of the projecting pins 207. Preferably, a spring 214 is provided for maintaining the teeth 210 projecting upwardly with respect to the surface 202 of the slide shoe 201. When the teeth 210 becomes subject to a load higher than a threshold load, the sliding teeth 210 rotates downwardly within the volume 205 of the slide shoe and it does not project upwardly from the retaining surface 202 of the slide shoe 201. If the load is removed, the sliding teeth 210 returns back in the projecting position. The spring is preloaded. The preload can be from about 10 g to 30 g. In embodiments of the invention, the preload can be of about 20 g. In general terms, the preload corresponds substantially to the weight of a document to be singularly feed in the printer.

Preferably, the projecting end of the sliding teeth 210 has a width substantially corresponding to the width of the trough 115. More precisely, the width of the sliding teeth 210 is such that it can engage with the friction surface 116 provided on the surface of the trough 115.

Preferably, the upper retaining surface 202 of the slide shoe 201 is covered with, lined with or made of (at least partially) a material providing a rather high friction with a document, which is typically made of paper of the like. In embodiments of the invention, the material of the upper surface 202 of the slide shoe 201 may be of rubber or the like. Friction coefficient of the covering material could be about 1.0-1.1 in compliance with ASTM 0618 Standard Test Mode. The upper retaining surface 202 can be covered by a rubber such as EPDM 70±5 Shore A.

Preferably, at least the projecting part of the sliding teeth 210 is made of a material providing a rather low friction with a document, typically made of paper or the like. In one embodiment, at least the projecting part of the sliding teeth 210 can be made of a blend of polyphenylene oxide (PPO) and polystyrene (PS). A preferred material is Noryl® SE 1, GFN2, FN 215 or any other polyphenylene ether. Alternative materials could be: ABS (Acrylonitrile butadiene styrene) polymer, PET, LDPE, MDPE or HDPE or a resin material or a combination thereof.

In other embodiments, the sliding teeth 210 can be replaced by a small wheel, a roller or the like.

Figure 3C:
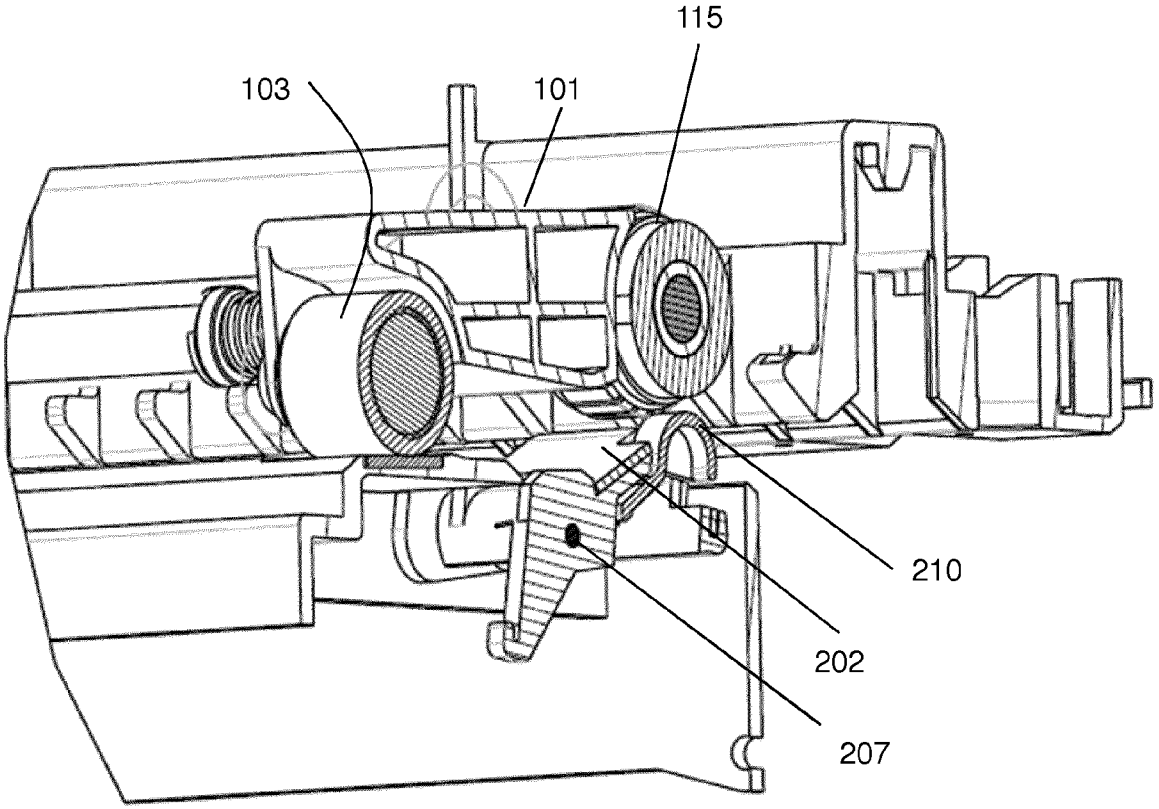

According to the first operation mode (FIGS. 3*b*, 3*c* and 6), the outer surface 113 of the feeding rollers 112 is at a distance from the retaining surface 202 of the slide shoe 201. In other words, the feeding rollers 112 are not in contact with the retaining surface 202 of the slide shoe 201. The distance between the surface 202 and the rubberized outer surface 113 of the feeding rollers 112 can be of about 1 to 2 mm. However, the sliding teeth 210 is projecting upwardly in the trough 115.

When a document D to be processed by the printer 1 is fed to the document feeder ADF in the first operation mode, the document D is slidingly supported by the projecting sliding teeth 210 and gently pushed upwardly towards the feeding rollers 112. However, the lower face of the document is not retained by the rubberized retaining surface 202 of the slide shoe 201, due to the projecting sliding teeth 210.

This operation mode is particularly profitable and convenient for feeding multi-copy documents because the lower sheet of the document is not retained with respect to the upper sheet. Therefore, it can be used for multi-copy documents connected along a lateral edge and not along a leading edge. Advantageously, peeling of the sheets does not occur.

The first operating mode can be selected manually, for instance by pressing a proper button. As an alternative, it can be automatically selected through use of proper sensor(s).

Figure 4:
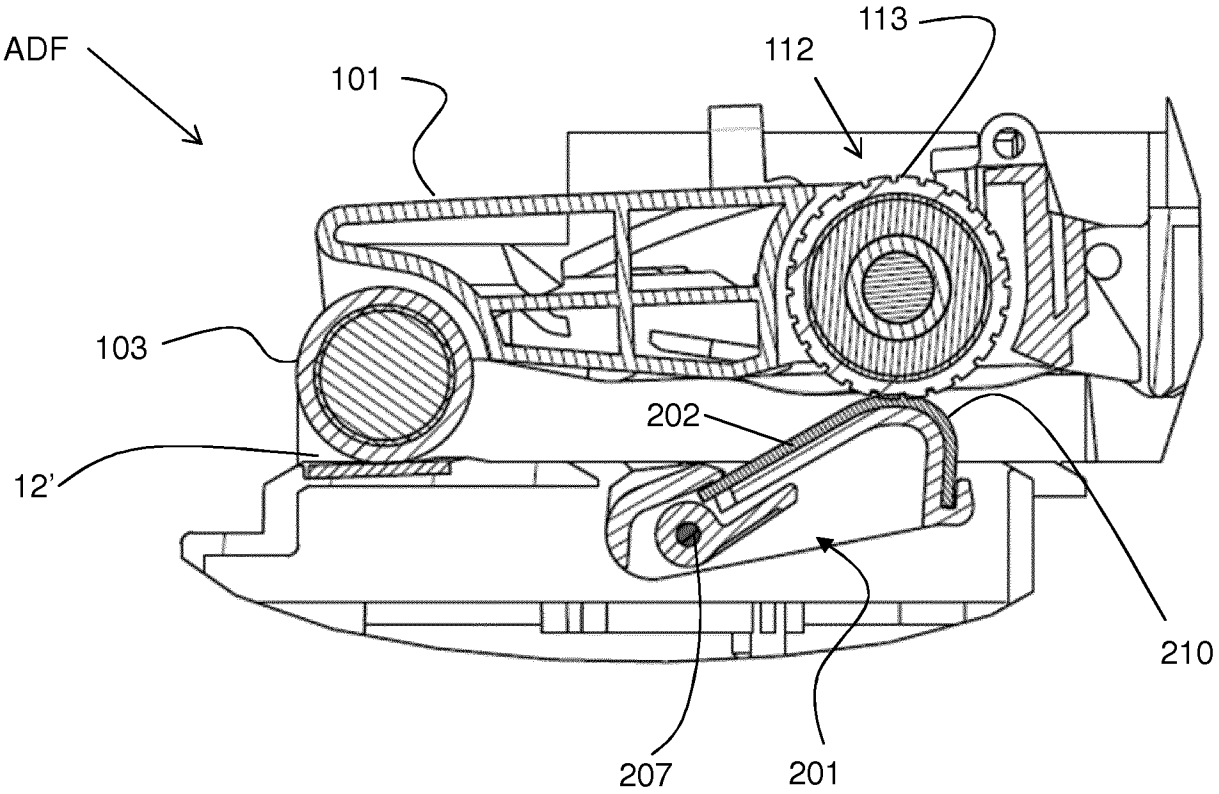
FIG. 4 is a view as the one of FIG. 3*b* for the second operation mode.

According to the second mode (FIG. 4), the rubberized outer surface 113 of the feeding rollers 112 is substantially in contact with the retaining surface 202 of the slide shoe 201. In principle, the sliding teeth 210 is projecting upwardly in the trough 115 but this has no influence with the transport of the document. In fact, the document maintained between the feeding rollers 112 presses the sliding teeth 210 downwardly. This operation mode is particularly profitable and convenient for feeding single-sheet documents which become sandwiched between the rubberized surfaces 113 of the feeding rollers 112 and of the retaining surface 202 of the slide shoe 201. The single-sheet documents can come from a stack of documents (not shown). The top document of the stack is provided by the pressing roller 103 of the upper part 100 of the document feeder ADF.

Figure 5A:
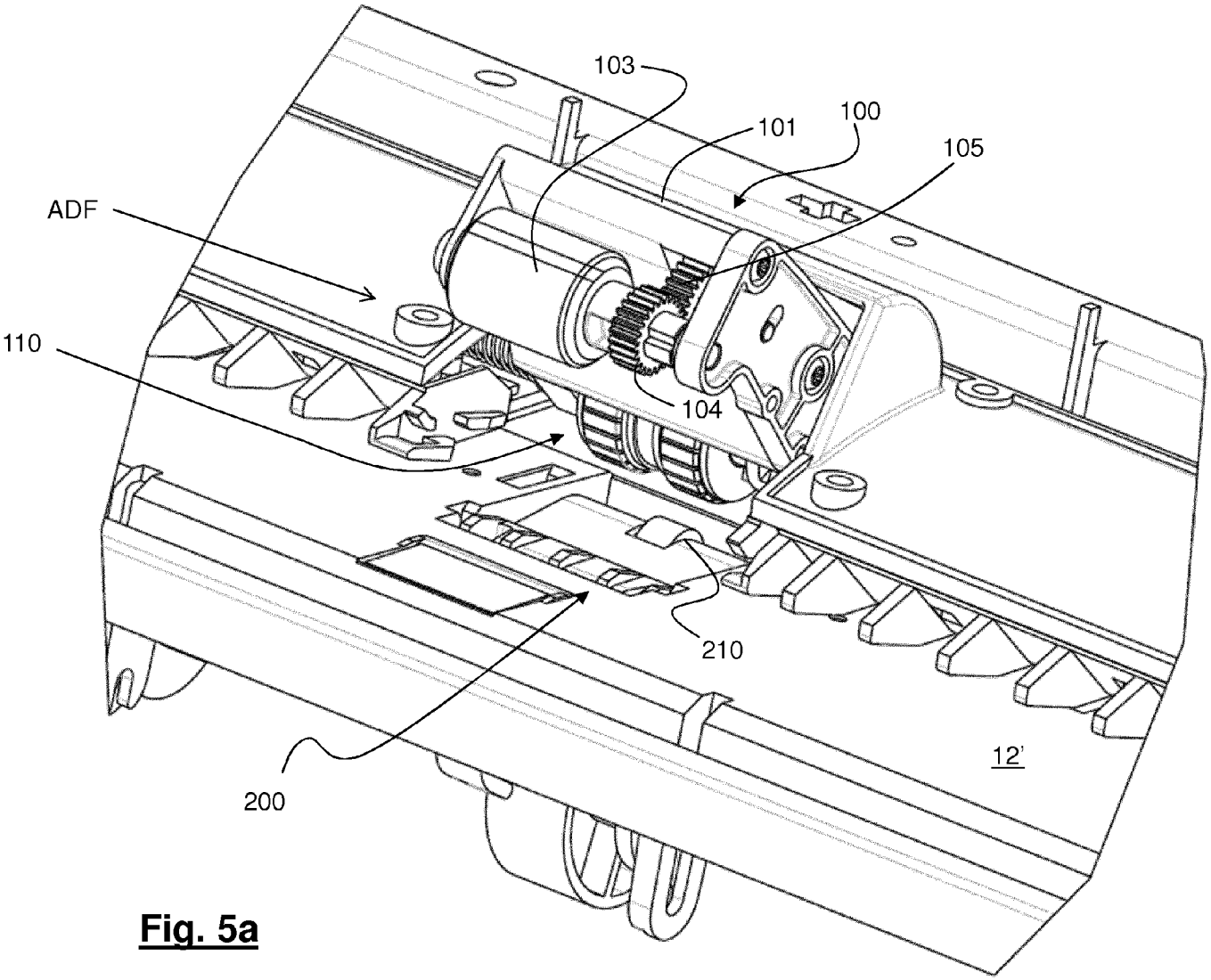
FIG. 5*a* is a view corresponding to FIG. 3*a* for the third operation mode.
Figure 5B:
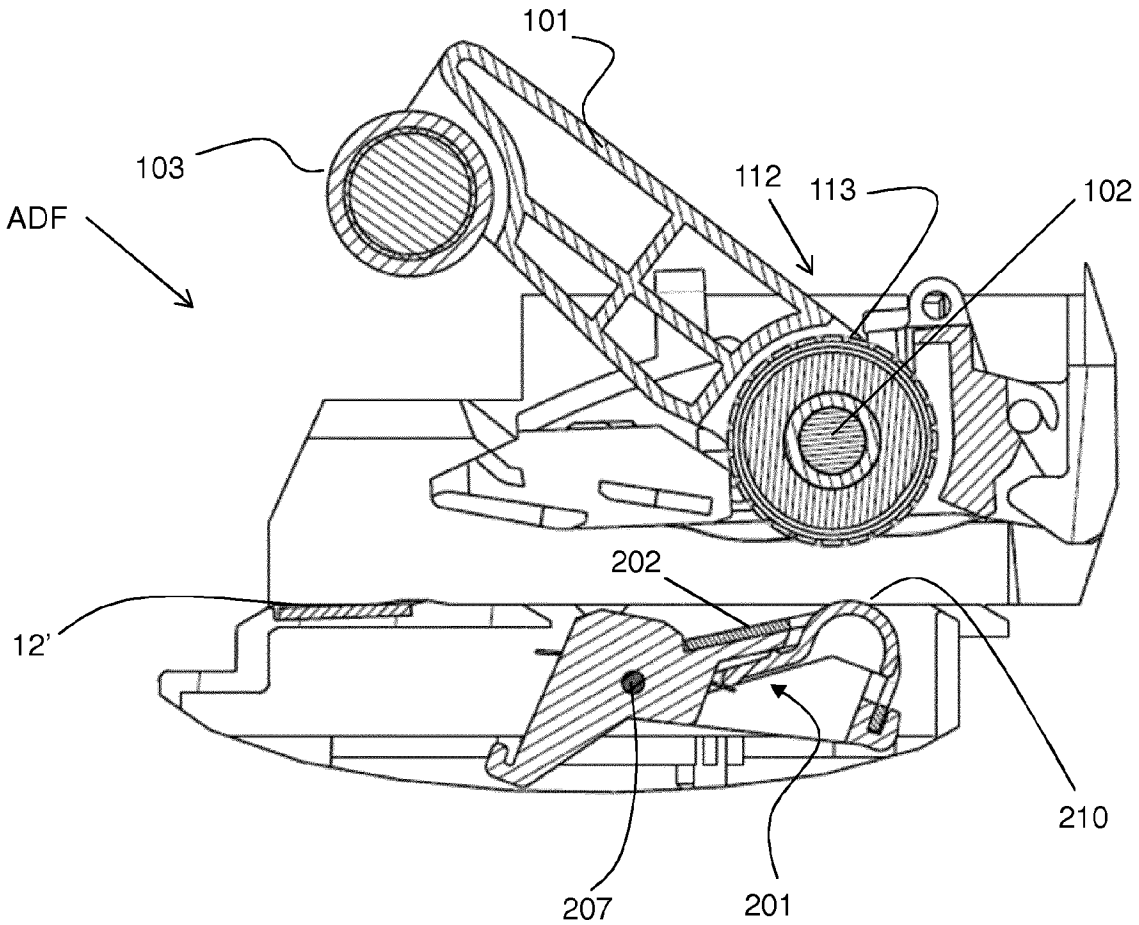
FIG. 5*b* is a simplified cross section of the improved document feeder according to an embodiment of the present invention in the third operation mode.

The third operation mode is shown in FIGS. 5*a* and 5*b* (as well as in FIGS. 2*a* and 2*b*). According to this third mode, the lower part 200 of the document feeder ADF is rotated so that it becomes recessed below the floor 12' of the feeding opening 12. In this configuration, it does not obstacles any document fed into the printer 1. Such documents can be fed manually.

The third operation mode is adapted to feed into the printer documents having a larger size than the size of the documents fed in the first operation mode. Such documents can be, for instance, documents having an A4 size or a similar size. The documents can be fed manually by a user who can properly arrange them at the alignment device(s) without being obstructed by the shape of the feeding opening 12.

The invention claimed is:

1. A document feeder for a printer, the document feeder comprising:

an upper part; and a lower part;

wherein the upper part comprises a feeding roller arrangement configured to engage with an upper face of a document, wherein the lower part comprises a retaining surface, wherein the lower part further comprises a sliding element which, in at least an operation mode of the document feeder, has a portion that projects with respect to the retaining surface for supporting a lower face of the document in such a way that at least a portion of the document is raised with respect to the retaining surface, and wherein the lower part is configured to move in such a way as to become recessed below a floor of a feeding opening of the printer.

2. The document feeder of claim 1, wherein the sliding element comprises a tooth configured to rotate around a rotation axis.

3. The document feeder of claim 1, wherein the lower part further comprises a spring configured to spring-load the sliding element in a projecting position.

4. The document feeder of claim 3, wherein the spring is preloaded with a load greater than or equal to 10 grams (g) and less than or equal to 30 g.

5. The document feeder of claim 1, wherein the sliding element comprises thermoplastic material.

6. The document feeder of claim 5, wherein the thermoplastic material comprises a blend of polyphenylene oxide and polystyrene.

7. The document feeder of claim 1, wherein the at least the portion of the sliding element that projects with respect to the retaining surface has a static coefficient of friction greater than or equal to about 1.0 and less than or equal to about 1.1.

8. The document feeder of claim 1, wherein the lower part is further configured to rotate.

9. The document feeder of claim 1, wherein the feeding roller arrangement comprises two motorized feeding rollers.

10. The document feeder of claim 9, wherein an outer surface of the two motorized feeding rollers is covered or lined with a rubber layer.

11. The document feeder of claim 9, wherein the feeding roller arrangement further comprises a trough between the two motorized feeding rollers.

12. A printer, comprising:

the document feeder of claim 1; and a feeding opening comprising the floor.

13. The printer of claim 12, wherein the printer further comprises a sensor configured to detect presence of the document.

14. The printer of claim 13, wherein one document output is selected among a plurality of outputs according to a detected size of the document, and wherein the size of the document is detected based on the sensor.

15. The document feeder of claim 1, wherein the at least the portion of the sliding element that projects with respect to the retaining surface has a kinetic coefficient of friction greater than or equal to about 1.0 and less than or equal to about 1.1.

16. The document feeder of claim 1, wherein the feeding roller arrangement comprises two feeding rollers.

17. The document feeder of claim 16, wherein an outer surface of the feeding rollers is covered or lined with a rubber layer.

18. A document feeder, comprising:

an upper part; and a lower part;

wherein the upper part comprises a feeding roller arrangement configured to engage with an upper face of a document, wherein the lower part comprises a retaining surface and a sliding element, wherein the sliding element is configured such that, in an operation mode of the document feeder, a portion of the sliding element projects with respect to the retaining surface to support a lower face of the document so that at least a portion of the document is raised with respect to the retaining surface, wherein the lower part further comprises a spring configured to spring-load the sliding element in a projecting position, and wherein the spring is preloaded with a load greater than or equal to 10 grams (g) and less than or equal to 30 g.

19. The document feeder of claim 18, wherein the sliding element is further configured such that, at least in the operation mode of the document feeder, the portion of the sliding element projects with respect to the retaining surface to support the lower face of the document so that the at least the portion of the document is raised with respect to the retaining surface.

* * * * *